United States Patent [19]

Atago et al.

[11] 3,945,205

[45] Mar. 23, 1976

[54] SECONDARY AIR CONTROL DEVICE

[75] Inventors: Takeshi Atago; Yukio Hosho; Shoji Shimo, all of Katsuta, Japan

[73] Assignee: Hitachi, Ltd., Japan

[22] Filed: Jan. 17, 1974

[21] Appl. No.: 434,062

[30] Foreign Application Priority Data

Jan. 22, 1973 Japan ..... 48-8598

[52] U.S. Cl. ..... 60/289; 60/290; 137/117; 137/501

[51] Int. Cl.[2] ..... F02B 75/10

[58] Field of Search ..... 60/289, 290, 307, 286; 137/117, 501; 417/300

[56] References Cited

UNITED STATES PATENTS

| | | | |
|---|---|---|---|
| 2,650,607 | 9/1953 | Bryant | 137/501 |
| 2,980,173 | 4/1961 | Perkey | 137/117 |
| 3,028,876 | 4/1962 | Gratzmuller | 137/501 |
| 3,360,927 | 1/1968 | Cornelius | 60/289 |
| 3,696,618 | 10/1972 | Boyd | 60/286 |
| 3,724,220 | 4/1973 | Tanasawa | 60/286 |
| 3,791,146 | 2/1974 | Hayashi | 60/289 |
| 3,805,522 | 4/1974 | Sheppard | 60/290 |
| 3,826,089 | 7/1974 | Nakajima | 60/289 |
| 3,892,071 | 7/1975 | Garcea | 60/290 |

*Primary Examiner*—Douglas Hart
*Attorney, Agent, or Firm*—Craig & Antonelli

[57] ABSTRACT

A secondary air control device which comprises an air passage communicating an air pump with a recombustion device and having a resistor such as an orifice provided midway of the passage and a control valve for maintaining substantially constant the pressure ratio of the pressure on the upstream side of the aforesaid resistor to that on the downstream side thereof, said control valve being so designed as to be operated in association with the pressure of the secondary air and that of exhaust gas, thereby eliminating fluctuation in pressure in the secondary air due to reduction in the discharging performance of the air pump, and thus the secondary air proportional in quantity to the exhaust gas from an engine may be supplied.

7 Claims, 6 Drawing Figures

SECONDARY AIR CONTROL DEVICE

Hitherto, to control a quantity of secondary air, a control valve has been used which is adapted to vary a secondary air supply cross-sectional area in response to suction pressure of an engine. Such a valve, however, involves a problem that, if the control valve passage area is initially set in accordance with the initial performance of an air pump, the difference in pressure between in the upstream passage of the control valve and in the downstream passage thereof is increased to a great extent due to the fact that the discharging performance of the air pump become lower as running time goes on, thereby leading to a large change in quantity of a secondary air supply. Now referring to FIG. 1, a character A is an initial quantity of discharged air from the pump and a character B is a quantity of discharged air which was measured after some running time goes on, respectively to the same discharging pressure. A character C denotes an optimum quantity of secondary air for the purpose of mere reference. Therefore, it can be seen that the degree of change of quantity of discharged air from the pump to a constant discharging pressure became larger as running time goes on, so that the lowering of the pumping performance is enlarged to such an extent that a quantity of secondary air is much less than that the optimum quantity C required for re-combustion, thus resulting in the failure of the exhaust gas purifying function.

In view of the aforesaid shortcomings, it is an object of the present invention to provide a device for controlling a quantity of secondary air, which is free from such a fluctuation in a secondary air which results from reduction in discharging performance of an air pump, thereby constantly providing an optimum recombustion condition.

Another object of the invention is to provide a secondary air control device, in which the quantity of a secondary air supplied is increased in association with the purifying action of an exhaust gas when accelerating a car.

A further object of the present invention is to provide a secondary air control device which permits adjustment of an air quantity to a required level, when such an air quantity need be restricted at the time of deceleration of a car or for protection of catalyst.

The features of the present invention exist in that a quantity of secondary air substantially proportional to the flow rate of exhaust gas may be supplied at predetermined ratio, so as to provide an optimum condition for an exhaust gas purifying performance in a recombustion device, such as a catalyst converter or a thermal reactance, and in that the characteristics of the secondary air supply may be determined irrespective of the discharging characteristic of an air pump, thereby accomodating the occurance of variation in the characteristics of an air pump and the time-dependent reduction in its performance as well.

Figure 1:
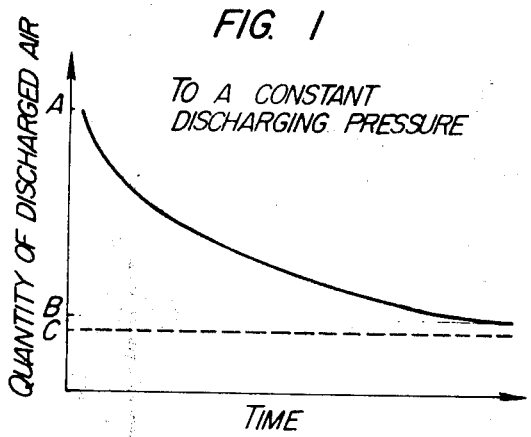
FIG. 1 is a plot illustrating a quantity of secondary air according to a conventional air pump.
Figure 2:
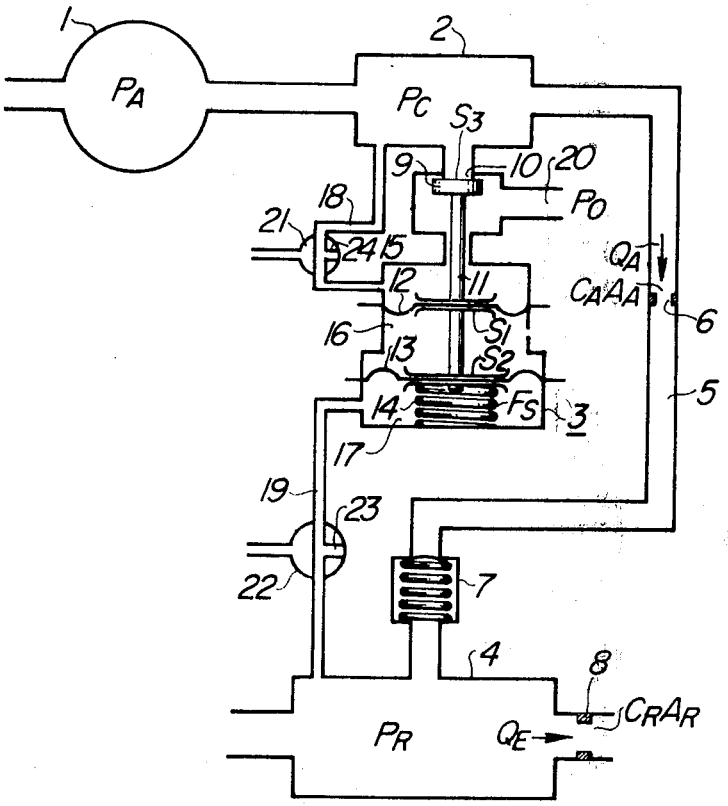
FIG. 2 is an explanatory view of an embodiment of a secondary air control device according to the present invention.

The description will hereunder be given on the embodiments of the present invention with reference to the accompanying drawings. Referring to FIG. 2, shown at 1 is an air pump, and at 2 a surge tank in which a secondary air from the air pump 1 is received for equilibrium. Designated at 3 is a control valve for adjusting pressures in the surge tank 2 and a re-combustion device 4, and at 5 an air passage communicating the surge tank 2 with the re-combustion device 4 and having a resistor 6 such as an orifice and a check valve 7 which are provided midway of the passage. The aforesaid re-combustion device 4 receives therein an exhaust gas from an engine and preserves a pressure $P_R$, commensurate with the exhaust gas by means of a resistor 8 provided in an outlet port thereof. Designated at 9 is a valve which acts to close an air passage 10 of the surge tank normally and connected by way of a rod 11 to diaphragm 12 and 13 which are provided within the aforesaid control valve 3, said diaphragm 13 being equipped with springs 14. Shown at 15, 16, and 17 are pressure chambers, respectively. The pressure chamber 15 is communicated by way of a pressure passage 18 with the surge tank, the pressure chamber 16 is communicated with atmosphere, and the pressure chamber 17 is communicated by way of a pressure passage 19 with the re-combustion device, respectively. Designated at 20 is a passage leading to atmosphere, through which the air within the surge tank is bled to atmosphere when the valve 9 is in the open position. Designated at 21 and 22 are three-way valves, which are disposed on the pressure passages 19 and 18, respectively and which are adjusted for varying pressure in the aforesaid respective pressure chambers. Shown at 23 and 24 are switching passages provided in the three-way valves 21 and 22, respectively.

In operation of the device of the present invention, the secondary air discharged from the air pump 1 is stored in the surge tank for equilibrium, then is subjected to pressure adjustment by the control valve, and supplied, past the orifice 6 and check valve 7 disposed in the air passage 5, to the re-combustion device 4. The re-combustion device 4 preserves the pressure $P_R$, commensurate with an exhaust gas quantity with the aid of the resistor 8, and hence an air quantity proportional to the exhaust gas quantity is supplied thereto from the surge tank. In FIG. 2, assume that $Q_E$ represents the flow rate of exhaust gas, $C_R$ does the flow coefficient in the orifice 8, $A_R$ does the cross-sectional area of the orifice 8, $\rho_E$ does the specific gravity of exhaust gas, $P_R$ does the pressure in the re-combustion device, $Q_A$ does the flow rate of secondary air, $C_A$ does the flow coefficient in the orifice 6, $A_A$ does the passage cross-sectional area in the orifice 6, $\rho_A$ does the specific gravity of secondary air and $P_C$ does the pressure in the surge tank. Then, the above-described relationship is represented by the following formulae. The flow rate of exhaust gas $$Q_E = C_R A_R \sqrt{2 \rho_E P_R} \quad (1)$$

The flow rate of secondary air $$Q_A = C_A A_A \sqrt{2 \rho_A (P_C - P_R)} \quad (2)$$

From the formulae (1) and (2), the relationship between $P_R$ and $P_C$ is represented by:

$$P_C = P_R \left\{1 + \frac{\rho_E}{\rho_A}\left(\frac{C_R A_R}{C_A A_A}\right)^2 \left(\frac{Q_A}{Q_E}\right)^2\right\} \quad (3),$$

wherein $Q_A/Q_E$ is a secondary air supply rate, $S_{AE}$, and if $$K = \frac{\rho_E}{\rho_A}\left(\frac{C_R A_R}{C_A A_A}\right)^2$$

then, the formula (3) will be:

$$P_C = P_R \{1+K (S_{AE})^2\} \quad (4)$$

$P_C$ is proportional to $P_R$ taking $S_{AE}$ (the secondary air supply rate) as a parameter. The above formula signifies that, by providing the resistor such as an orifice midway of the secondary air supply pipe leading to the exhaust gas re-combustion device, so as to vary the pressure in the upstream passage of the orifice in association with the pressure in the re-combustion device, in other words, by determining $P_C$ for $P_R$ as represented in the formula (4), $Q_A$ (the secondary air) may be supplied at the secondary air supply rate $S_{AE}$ equal to the exhaust gas quantity $Q_E$. As is obvious from the formula (4), because of the freedom from the factor of the air pump performance $P_A$, the secondary air quantity may be independent of the air pump performance, and thus, a proper quantity of air is ensured.

A pressure adjusting mechanism will be referred to hereunder. Assume that $S_1$ represents an effective area of the diaphragm 12, $S_2$ does an effective area of the diaphragm 13, $S_3$ does an effective area of the valve 9, $P_O$ does atmospheric pressure, and $F_S$ does a spring force of the springs 14. Then, the adjusted pressure may be represented by the following formula:

$$P_C = \frac{S_2}{(S_1 + S_2)} P_R + \frac{S_3}{(S_1 + S_3)} P_O + \frac{F_S}{(S_1 + S_2)} \quad (5)$$

In detail, the air passage 10 is normally closed by the valve 9. Upon opening of the air passage 10, the pressure in the surge tank will be bled in the passage leading to atmosphere 20, thereby adjusting the pressure in the surge tank. The valve 9 is connected by way of the rod 11 to the diaphragms 12 and 13, with the diaphragm 12 being communicated by way of the pressure passage 18 with the pressure chamber 15 as well as with the surge tank, such that a force commensurate with $P_C$ acts on the valve 9 in the direction of opening same. While, the diaphragm 13 is communicated by way of the pressure passage 19 with the pressure chamber 17, such that a force is exerted on the valve 9 by $P_R$ in the direction of closing same. The springs 14 act under the spring force $F_S$ to set an initial position of the valve, while the pressure chamber 16 remains open to atmosphere. Furthermore, $P_C$ acts on the valve in the direction of opening same under the situation described, $P_C$ will be such as is expressed by the formula given above, wherein since $P_O$ is an atmospheric pressure, the second term results in zero, and in addition, since $F_S$ is 100 to 300 g or thereabout, the third term is negligible, in comparison with the first term. Then, the formula (5) will be equal to the formula (6):

$$P_C = \frac{S_2}{(S_1 + S_2)} P_R \quad (6)$$

As is obvious from the formula (6), $P_C$ may be selected to a proper rate depending on the areas of the diaphragms 12 and 13 and the valve 9, to thereby attain the relationship given by the formula (4). One of features of the invention, in this respect, is that for adjusting pressure, air is discharged to atmosphere, with the resultant reduction in the load to be exerted on the air pump.

Figure 6:
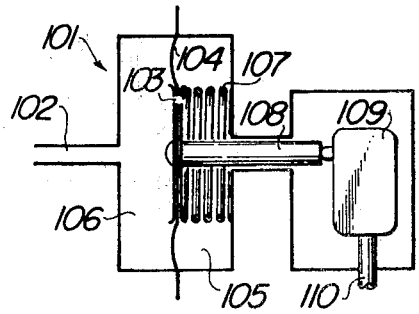
Figure 5:
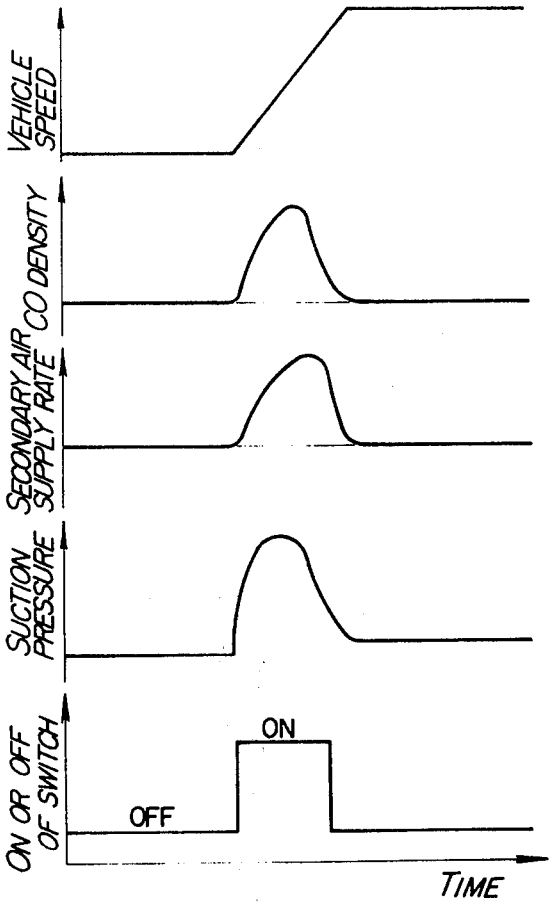
FIG. 5 are plots illustrating the condition of associated factors versus time; and, FIG. 6 is a longitudinal sectional view of an embodiment of an acceleration-detecting device suited for the present invention.

Upon acceleration of a car, a quantity of secondary air which is supplied to the re-combustion device should be increased. This fact is also taken into consideration in the present invention. FIG. 5 are plots illustrating the condition of associated factors versus time when accelerating the car. Suppose that the acceleration is effected in a manner as is shown in the plot (*a*), then $C_O$ concentration increases due to the increase in the concentration of fuel, as plotted in (*b*), and hence the secondary air supply rate need be increased as plotted in (*c*). On the other hand, the suction pressure is subjected to a change as plotted in (*d*) when in acceleration. By detecting signals representing the variation, a switch is rendered on or off when in acceleration, as plotted in (*e*), thereby controlling the quantity of the secondary air. An acceleration switch used to this end is exemplified by FIG. 6. Designated at 101 is an acceleration-detecting device having a negative pressure passage 102 communicated with a suction pipe of engine. With increase in the internal pressure in a pressure chamber 106 when in acceleration, a movable member 104 will be urged right-wardly against the spring force of springs 107, and a micro-switch 109 is pushed by a rod 108, whereby the signals as plotted in FIG. 5(*e*) are produced through a lead wire 110. A duration, during which the signals are being produced is determined to a proper value by adjusting the duration, during which the pressures in both pressure chambers 105 and 106 come to an equilibrium by means of an opening, i.e. a jet 103 provided in the movable member 104 in a manner to communicate both pressure chambers with each other. The acceleration signal thus detected is fed by the lead wire 110 to the three-way valve 21. By closing the valve 21, the pressure in the surge tank 2 no longer acts on the pressure chamber 15 and the force acting on the valve 9 in the direction of opening same becomes reduced. Thus, the force which is exerted by the exhaust gas on the valve 9 in the direction of closing same becomes increased, to thereby bring the control valve 3 into a fully closed position, whereby discharge air from the air pump may be supplied, in quantity commensurate with acceleration, to the re-combustion device. In the above embodiment, the switching-on or -off of the acceleration switch is effected by resorting to the suction negative pressure, and it may be effected in association with the factors such as the r.p.m. of the engine, a relationship between a car speed and throttle open rate, etc.

In case there arises a requirement for restricting a secondary air supply quantity, from the viewpoint of the catalyst protection, the three-way valve 22 is operated to block the re-combustion gas pressure acting on the pressure chamber 17, to thereby open the valve 9, whereby the discharge air from the air pump 1 will be delivered into atmosphere, thereby reducing the quantity of secondary air supply. In this case, control for the quantity of secondary air may be effected by detecting the factors such as temperature in the re-combustion device or oxygen contained in the exhaust gas.

Figure 3:
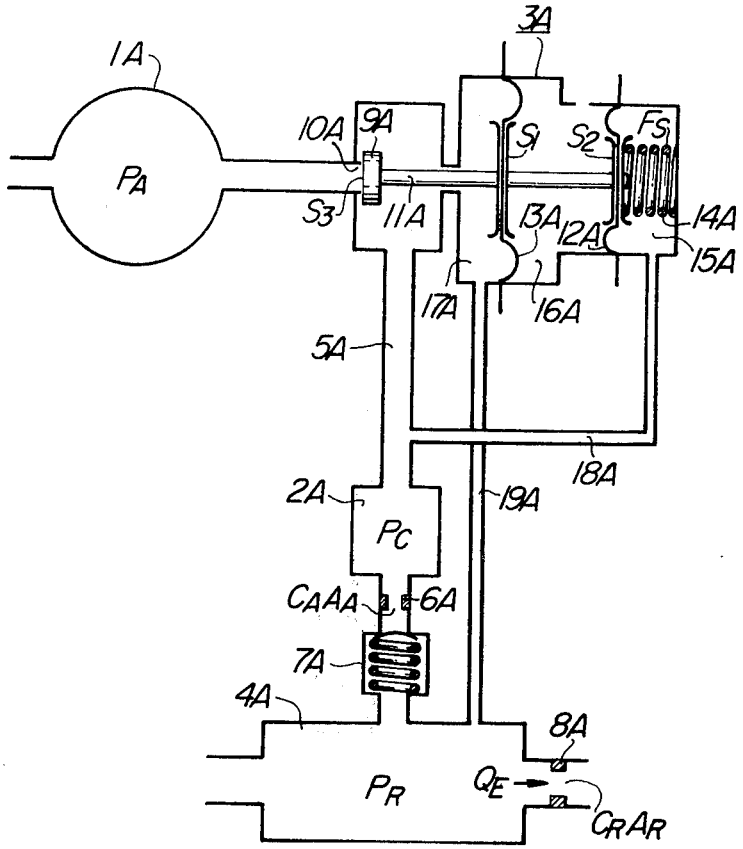
FIGS. 3 and 4 are illustrations of further embodiments of the secondary air control device according to the present invention.
Figure 4:
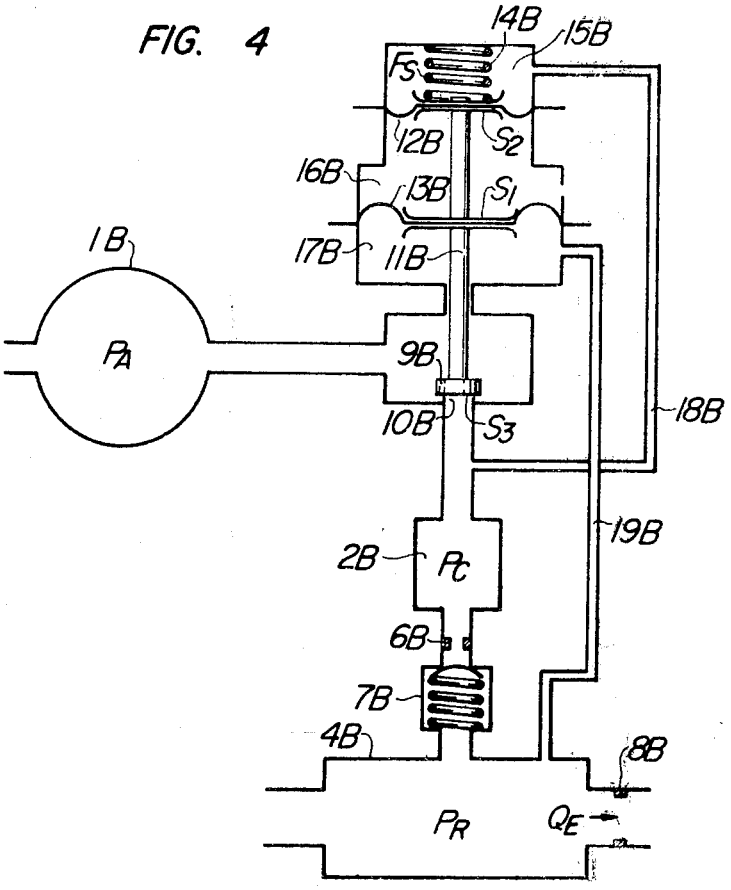

FIGS. 3 and 4 show further embodiments of the present invention, respectively. These embodiments are discriminated from the first embodiment described in whether air in the surge tank is delivered into atmosphere or not. This will be described with reference to the embodiment of FIG. 3. Upon starting of an engine, the internal pressure in a re-combustion chamber 4A increases due to the exhaust gas produced and is then transmitted by way of a pressure passage 19A to a pressure chamber 17A, whereby a movable member 13A is biased rightwardly. With the movement of the movable member 13A, a valve 9A is opened, and the secondary air of a quantity commensurate with the exhaust gas is fed to the re-combustion device. In the event that a quantity of secondary air which is supplied to the re-combustion device becomes increased more than required, the pressure within an air passage 5A becomes increased, and transmitted by way of a pressure passage 18A to a pressure chamber 15A. Thus, the pressure in the chamber 15A acts on the valve 9A in the direction of closing same, such that a proper quantity of secondary air commensurate with the exhaust gas may be supplied to the re-combustion device. The embodiment of FIG. 4 operates as in the embodiment of FIG. 3.

According to the present invention, a resistor is provided midway of the secondary air supply passage connecting the surge tank with the re-combustion device, and the pressure on the upstream side of the resistor is associated by way of a control valve or the like with the pressure on the downstream side thereof, whereby an adverse influence due to the time-dependent reduction in the air pump characteristic may be avoided, with the result that the secondary air of a quantity proportional to the flow rate of exhaust gas may be fed to the recombustion device constantly at a predetermined rate, thereby maintaining the purifications by the exhaust gas in optimum condition, while extending a service life of the air pump. In addition, there is provided in the secondary air control device means for increasing a quantity of secondary air or interrupting the supply thereof.

What is claimed is:

1. In a secondary air control device in which secondary air from an air pump is supplied through an air passage to an exhaust gas purifying re-combustion device to burn combustible components contained in the exhaust gas from an engine within the re-combustion device, the improvement comprising an orifice mounted in the air passage, and control valve means operatively associated with the air passage communicating the air pump with the orifice for varying pressure on the upstream side of the orifice in response to pressure in the re-combustion device and maintaining a substantially constant ratio of the pressure on the upstream side of the orifice to the pressure in the re-combustion device.

2. In a secondary air control device according to claim 1, wherein a surge tank is connected with said air passage, and said control valve means comprises a vent passage for discharging air from the surge tank into the atmosphere and means for controlling the quantity of air discharged through said vent passage in response to pressure in the re-combustion device.

3. In a secondary air control device according to claim 2, wherein said air quantity discharge controlling means includes a valve housing, a valve body in the valve housing for varying the quantity of air discharged into the atmosphere, and a pair of diaphragms connected with the valve body to define three independent pressure chambers in the valve housing.

4. In a secondary air control device according to claim 3, wherein a first passage means communicates a first of the pressure chambers with the surge tank, a second passage means communicates a second of the pressure chambers with the re-combustion device, and a third pressure chamber located between the first and second pressure chambers communicates with the atmosphere.

5. In a secondary air control device according to claim 4, wherein a three-way valve means is associated with the first passage means for actuation in response to means for detecting the acceleration condition of the engine and communicating the first pressure chamber with the atmosphere at times of acceleration.

6. In a secondary air control device according to claim 5, wherein a three-way valve is associated with the second passage means for actuation in response to means for detecting the quantity of secondary air and opening the valve body to discharge the secondary air into the atmosphere when it becomes necessary to protect a catalyst associated with the re-combustion device.

7. In a secondary air control device according to claim 6, wherein an orifice is provided at the outlet portion of the re-combustion device.

* * * * *